US007500669B2

(12) United States Patent
Mandel

(10) Patent No.: US 7,500,669 B2
(45) Date of Patent: Mar. 10, 2009

(54) REGISTRATION OF TAB MEDIA

(75) Inventor: Barry Paul Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 284 days.

(21) Appl. No.: 11/403,786

(22) Filed: Apr. 13, 2006

(65) Prior Publication Data

US 2007/0257423 A1 Nov. 8, 2007

(51) Int. Cl.
*B65H 7/02* (2006.01)
*B65H 5/00* (2006.01)

(52) U.S. Cl. ..... 271/227; 271/228; 271/1

(58) Field of Classification Search ..... 271/227, 271/228, 1

See application file for complete search history.

(56) References Cited

U.S. PATENT DOCUMENTS

| | | | | |
|---|---|---|---|---|
| 3,949,979 | A | 4/1976 | Taylor et al. | |
| 4,054,380 | A | 10/1977 | Donohue et al. | |
| 4,062,061 | A | 12/1977 | Batchelor et al. | |
| 4,076,408 | A | 2/1978 | Reid et al. | |
| 4,078,787 | A | 3/1978 | Burlew et al. | |
| 4,099,860 | A | 7/1978 | Connin | |
| 4,125,325 | A | 11/1978 | Batchelor et al. | |
| 4,128,327 | A | 12/1978 | Sugiyama et al. | |
| 4,132,401 | A | 1/1979 | Gauronski et al. | |
| 4,144,550 | A | 3/1979 | Donohue et al. | |
| 4,158,500 | A | 6/1979 | DiFrancesco et al. | |
| 4,176,945 | A | 12/1979 | Holzhauser et al. | |
| 4,179,215 | A | 12/1979 | Hage | |
| 4,229,101 | A | 10/1980 | Hamlin et al. | |
| 4,278,344 | A | 7/1981 | Sahay | |
| 4,332,464 | A | 6/1982 | Bartulis et al. | |
| 4,782,363 | A | 11/1988 | Britt et al. | |
| 5,078,384 | A * | 1/1992 | Moore | 271/228 |
| 5,169,140 | A * | 12/1992 | Wenthe, Jr. | 271/228 |
| 5,278,624 | A * | 1/1994 | Kamprath et al. | 399/395 |
| 5,452,062 | A * | 9/1995 | Baldwin et al. | 399/382 |
| 5,678,159 | A * | 10/1997 | Williams et al. | 399/395 |
| 5,794,176 | A * | 8/1998 | Milillo | 702/150 |
| 5,848,320 | A * | 12/1998 | Yaginuma et al. | 399/45 |
| 6,488,275 | B2 * | 12/2002 | Schlageter | 271/10.01 |
| 6,758,471 | B2 * | 7/2004 | Hirako | 271/258.01 |
| 4,475,156 | A1 | 11/2004 | Hermann et al. | |
| 6,819,906 | B1 | 11/2004 | Herrmann et al. | |
| 6,997,455 | B2 * | 2/2006 | Romine | 271/227 |
| 7,088,948 | B2 * | 8/2006 | Puckett et al. | 399/395 |
| 7,293,768 | B2 * | 11/2007 | Satoh | 271/258.01 |
| 2004/0094891 | A1 * | 5/2004 | Trovinger et al. | 271/227 |

* cited by examiner

*Primary Examiner*—Patrick H Mackey
*Assistant Examiner*—Luis Gonzalez
(74) *Attorney, Agent, or Firm*—Fay Sharpe LLP

(57) ABSTRACT

A printing system for printing images onto copy sheets and tab stock includes a media registration transport for transporting a media sheet along a path. The printing system further includes a sensing system having a plurality of sensors positioned in line and orthogonal to the feed direction of the sheet path for detecting a leading edge of the media sheet. A control system provides for detecting signals at the times when each of the plurality of sensors are occluded and a control algorithm compares every one of the sensor signals with each other of the sensor signals. The system then identifies at least one pair of sensor signals having inconsistent readings with the other of sensor signals and, determines the presence of a tab on the leading edge based on the inconsistent sensor signal readings and calculates sheet skew based on the other sensor signals.

20 Claims, 3 Drawing Sheets

REGISTRATION OF TAB MEDIA

BACKGROUND

The present exemplary embodiments relate to a printer apparatus or the like, and more particularly, to printing on tab stock, i.e., heavy weight media or sheets having an irregular, protruding portion on one edge thereof, with such a printer.

Duplex printing of tab stock requires feeding the tab stock with the tab edge leading from through the registration transport. This requirement is incompatible with machines using stalled roll deskew registration as shown, for example in U.S. Pat. Nos. 3,949,979 and 4,128,327. No provision is made in the systems of these patents for providing deskew of tab stock.

Other existing printing products can print tabs in duplex mode by using an edge registration system, i.e. the sheets are biased against their top or bottom edge using a cross-roll or other edge registration system.

While still other systems are limited to printing tab sheets in simplex mode only; such as, for example where two sensors are used to detect lead edge skew and an electronic (or differential drive) mechanism is used to deskew the sheets. If the tabbed sheets were inverted for printing on side two, the tab would be on the leading edge of the sheet which would create problems when the lead edge passed the two skew sensors. Also, since only two point sensors are used, and they must be located to detect the smallest size media handled by the system, the accuracy of the skew reading is compromised when the larger baseline media is being used.

Accordingly, disclosed herein is a printer including a registration media sensing system that can handle tabbed sheets, even with the tab leading (on the leading edge). The system makes use of multiple sensors, for example point sensors, to detect the presence of a tab and to determine the lead edge skew of the sheet.

The disclosed apparatus may be readily operated and controlled in a conventional manner with known or conventional copier or printer control systems, operated as taught herein. Some additional examples of various prior art copiers with document handlers and control systems therefore, including sheet detecting switches, sensors, etc., are disclosed in U.S. Pat. Nos. 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; and 4,475,156. It is well known in general and preferable to program and execute such control functions and logic with known software instructions for known microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems.

As shown in the above-cited art, the control of exemplary document and copy sheet handling systems in copiers or printers may be accomplished by conventionally actuating them by signals from the copier controller directly or indirectly in response to simple programmed commands and from selected actuation or non-actuation of conventional copier switch inputs by the copier operator, such as switches selecting the number of copies to be made in that run, selecting simplex or duplex copying, selecting whether the documents are simplex or duplex, selecting a copy sheet supply tray, etc. The operator inputs and controls, and machine internal controls or limits, may be coordinated and/or made interactive with operator displays and "prompts" or instructions; e.g., U.S. Pat. No. 4,332,464 issued Jun. 1, 1982 regarding the Xerox Corporation "5700" printer. The resultant controller signals may conventionally actuate various conventional electrical solenoid or cam-control led sheet deflector fingers, motors or clutches in the copier in the selected steps or sequences as programmed. Conventional sheet path sensors, switches and bail bars, connected to the controller, may be utilized for sensing and timing the positions of documents and copy sheets, as is well known in the art, and taught in the above and other patents and products. Known copying systems utilize such conventional microprocessor control circuitry with such connecting switches and sensors for counting and comparing the numbers of document and copy sheets as they are fed and circulated, keeping track of their general positions, counting the number of completed document set circulations and completed copies, etc. and thereby controlling the operation of the document and copy sheet feeders and inverters, etc.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example(s) below, as well as the claims. Thus, the present exemplary embodiments will be better understood from this description of an embodiment thereof, including the drawing figures.

BRIEF SUMMARY

In one aspect, a printing system is provided for printing images onto copy sheets and tab stock including a media registration transport for transporting a media sheet along a path. The printing system further provides a sensing system having a plurality of sensors positioned in line and orthogonal to the feed direction of the sheet path for detecting a leading edge of the media sheet. A control system provides for detecting signals at the times when each of the plurality of sensors are occluded and a control algorithm compares each one of the sensor signals with each other of the sensor signals. The system then identifies at least one pair of sensor signals having inconsistent readings with the other of sensor signals and, determines the presence of a tab on the leading edge based on the inconsistent sensor signal readings.

In another aspect, a method of printing is employed including transporting a media sheet along a media registration transport path. The method of printing provides for detecting a leading edge of the media sheet including a sensing system with a plurality of sensors positioned in line and orthogonal to the feed direction of the sheet path adapted to detect signals at the times when at least three of the plurality of sensors are occluded by the leading edge. Each one of the sensor signals can then be compared with each other of the sensor signals in order to identify at least one pair of sensor signals having inconsistent readings with the other of sensor signals. The method thus determines the presence of a tab on the leading edge based on the inconsistent sensor signal readings.

In yet another aspect, a printing system is provided comprising a media registration transport for transporting a media sheet along a path and a sensing system including a plurality of sensors positioned in line and orthogonal to the feed direction of the sheet path for detecting a leading edge of the media sheet. The system further comprises a control system for detecting trip times when at least three of the plurality of sensors are occluded including a control algorithm for comparing each one of the sensor signals with each other of the sensor signals. The system identifies at least one pair of sensor signals having inconsistent readings with the other of sensor signals and then determines the presence of a tab on the leading edge based on the inconsistent sensor signal readings.

In still yet another aspect, a printing system is provided comprising a media registration transport for transporting a tabbed media sheet along a sheet path and a sensing system including a plurality of sensors positioned substantially in line and orthogonal to a feed direction of the sheet path for detecting a leading edge of the tabbed media sheet. The system further comprises a control system for detecting trip times when each of the plurality of sensors are occluded including a control algorithm having knowledge of a location of a tab on the tabbed media sheet to determine which sensor signals are to be ignored when calculating sheet skew based on the trip times of the plurality of sensors.

And still further, a printing system is provide comprising a media registration transport for transporting a media sheet having a tab along a path and a sensing system including a plurality of sensors positioned substantially in line and orthogonal to the feed direction of the sheet path for detecting a leading edge of the media sheet. The system further comprises a control system for detecting trip times when each of the plurality of sensors are occluded including a control algorithm having knowledge of the location and width of the tab on the media sheet and using a correction factor to compensate for the width of the tab when calculating sheet skew based on the trip times of the plurality of sensors.

DETAILED DESCRIPTION

Figure 1:
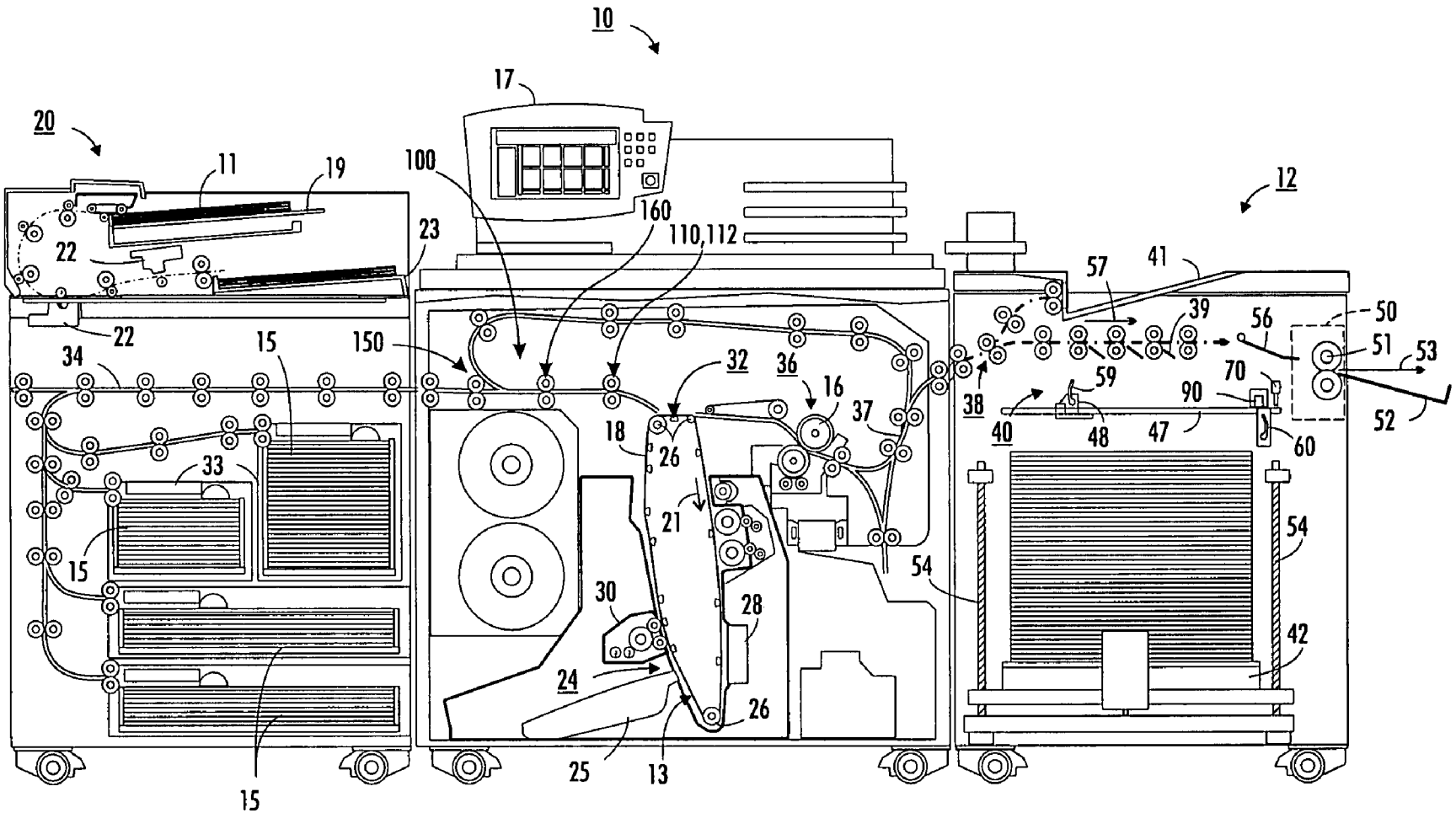
FIG. 1 shows an exemplary compiler/finisher/set stacker system in a modular unit connected to the output of an exemplary xerographic printer.

Describing now in further detail the exemplary embodiment with reference to the FIG. 1, there is shown a duplex printer reproducing machine 10 by way of one example of an apparatus in which the particular disclosed apparatus of the present exemplary embodiments may be utilized. FIG. 1 shows a schematic front elevational view of one example of a subject finishing system, station, or module 12 incorporating an exemplary sheet compiling station or system 40, an (optional) finisher example of a conventional set stapler (not illustrated), and an exemplary compiled sets stacking tray system 42. The finishing system 12 is shown here in FIG. 1 directly adjacent to (or integral) an exemplary high-speed, high-volume document creating apparatus 10, such as, for example, the xerographic printer shown here, from which a series of printed sheets with image reproductions thereon may be directly fed seriatim to the finishing system 12 for production of desired sets of these printed sheets, normally collated sets.

Referring further to the FIG. 1 printer 10, as in other xerographic machines, and as is well known, an electronic document or an electronic or optical image of an original document or set of documents to be reproduced may be projected or scanned onto a charged surface 13 of a photoreceptor belt 18 to form an electrostatic latent image. Optionally, a document handler 20 may be provided to scan at a scanning station 22 paper documents 11 fed from a tray 19 to a tray 23. The latent image is developed with developing material to form a toner image corresponding to the latent image. The toner image is then electrostatically transferred to a final print media material, such as paper sheets 15, to which it may be permanently fixed by a fusing device 16. The machine operator may enter the desired printing and finishing instructions through the control panel 17, or, with a job ticket, an electronic print job description from a remote source, or otherwise.

The belt photoreceptor 18 here is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and transfer station 32. A sheet 15 is fed from a selected paper tray supply 33 to a sheet transport 34 for travel to the transfer station 32. Transfer of the toner image to the sheet is effected and the sheet is stripped from the photoreceptor and conveyed to a fusing station 36 having fusing device 16 where the toner image is fused to the sheet. The sheet 15 is then transported by a sheet output transport 37 to the finishing station 12 where plural sheets 15 may be accumulated to be compiled into superposed sets of sheets and optionally fastened together (finished) by being stapled, bound, or the like.

In order to ensure that the sheets fed from feed module 20 are accurately aligned with the image on the photoreceptor 32, a sheet registration transport 100 is located just upstream of the photoreceptor image transfer point. Transport 100 may consist of independently driven rollers 110 and 112 which can be used to deskew and optionally laterally shift the media, and a set of pre-registration transport drive nips 150 and 160 that can open or release to allow the sheets to be deskewed or laterally shifted by drive rolls 110 and 112.

The following terms regarding the example here are hereby defined. "UI" is the User Interface, in this case the interactive CRT, or liquid crystal or other operator control console display panel and touch area or switch inputs connected to the system controller. It may also be called a UIT or User Interface Terminal. This is where document handling, or finisher or other machine functions or modes are programmed in by the operator. The disclosed system can be used to determine, for example which of the five document handling modes (Recirculating Document Handler (RDH), (Semi-Automatic Document Handler (SADH), Computer Forms Feeder (CFF), Platen, and Book copying) the operator is trying to use for scanning. E.g., document scanning in Book Mode or CFF Mode are "selected" by the operator at the UIT in this example. ESS is the Electronic Sub-System or system control. IIT is the Image Input Terminal, also called a scanner in this example, but it does more than just image scan here. (Another term for this is EFE or Electronic Front End). IOT is the Image Output Terminal, which writes or prints (with a laser beam) the marks on the (copy) paper. DH is the overall Document Handler, or feeder, also referred to hereinbelow as the "UDH" or universal document handler with both an RDH document stacking tray input and a SADH/CFF document input into which either computer form web (usually fan-fold) feeding (CFF) or large or other individual documents may be loaded and fed.

As shown in FIG. 1, the printer machine 10 and its original document presentation system may be like that disclosed in Xerox Corporation U.S. Pat. No. 6,819,906, issued Nov. 16, 2004 to Herrmann et al. An electronic document imaging system, and a laser scanning system imaging a photoreceptor, may be provided as shown here and in the above cross-referenced applications. Alternatively this may be a conventional optical imaging system. As discussed above, operator inputs and controls and machine internal controls and operator displays and "prompts" or instructions are provided in a controller with displays. The document handler may also be like that in Xerox Corporation U.S. Pat. No. 4,579,444, and the finisher may also be like that shown and described in Xerox Corporation U.S. Pat. No. 4,782,363.

Figure 2:
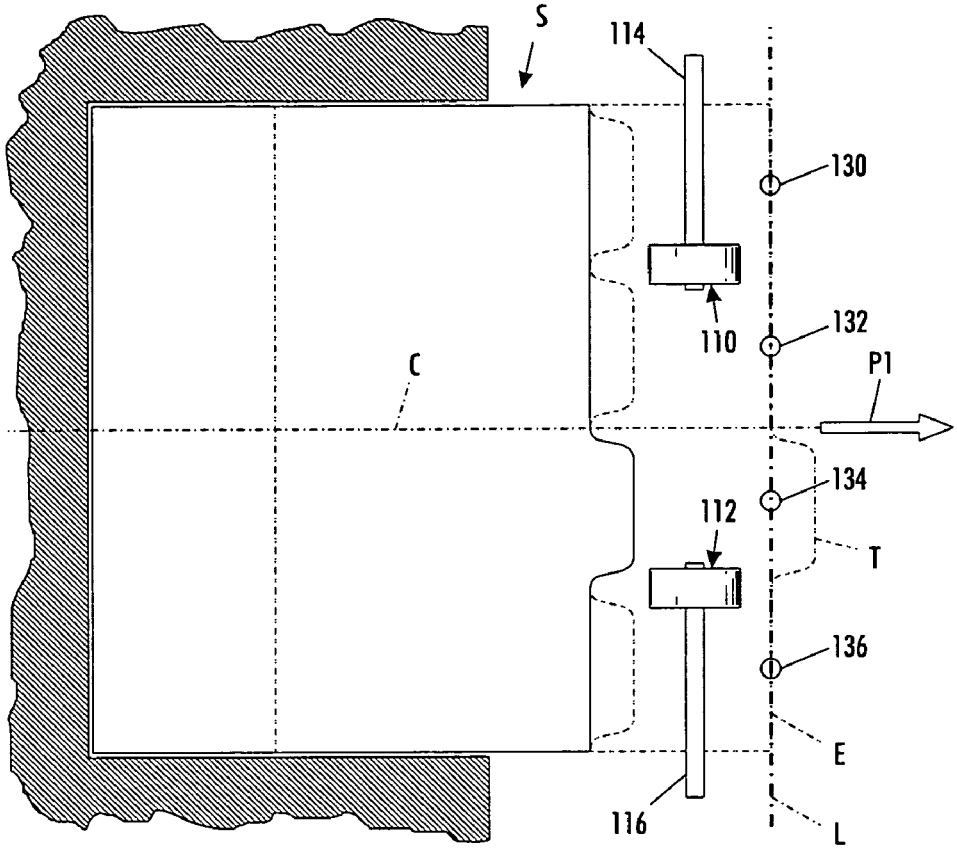
FIG. 2 is a partial plan view of the subject system of the present exemplary embodiments showing in line sensors for sensing tab stock and sheet skew; and, FIG. 3 is an example control algorithm utilizing a four (4) point sensor model.

Referring now to FIG. 2, a sheet S is advanced along ingress paper path P1 which may be any surface over which paper sheets will be passed, into the pair of nip roll pairs 110 and 112, each respectively comprising driving rollers and idler rollers which frictionally engage sheet S therebetween. The driving and idler rollers are generally provided with an elastomer or plastic surface suitable for substantially non-slipping engagement of sheets passed therebetween. Driving rollers are respectively supported for controllable rotating driving motion on roller shafts 114 and 116. The shafts 114, 116 can be supported at both ends by frame mounted bearings and driven by separate motors (not illustrated). Drive rollers 110 and 112 can be used to deskew or laterally register the sheet S as it is transported along path P1, however it should be appreciated that many alternate sheet registration mechanisms can be used in conjunction with the proposed sensing and control scheme.

Figure 3:
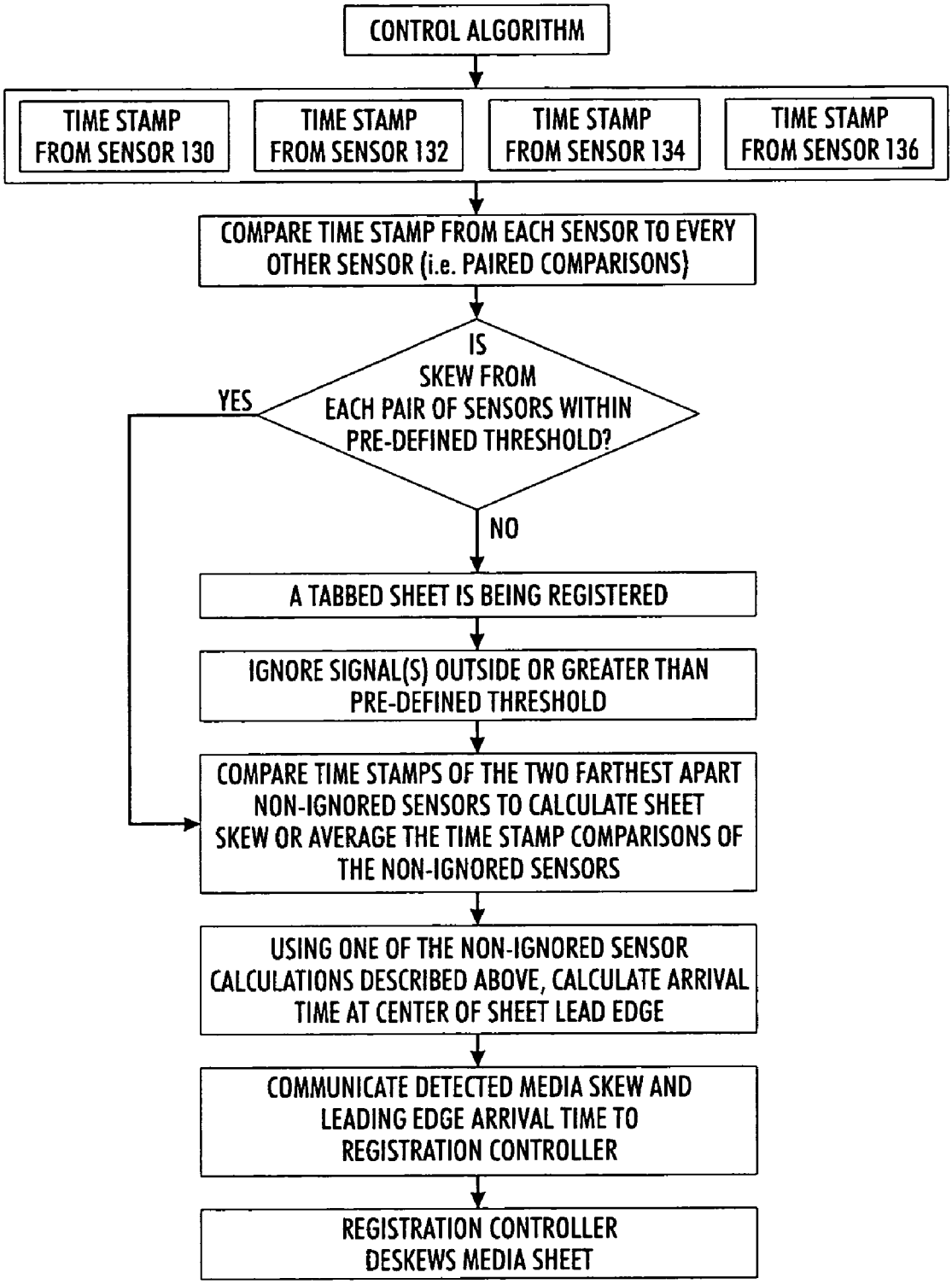

Paper path P1 can be provided with a series of sensors 130, 132, 134, 136. The sensors can be suitably spaced substantially on a line L arranged generally perpendicularly to the path of paper sheet travel (x-or process direction) along paper path P1. In one embodiment the spacing of sensors 130 and 136 can be approximately equidistant from a paper path centerline C. Similarly, the spacing of sensors 132 and 134 can be approximately equidistant from a paper path centerline C, albeit different than spacing 130 and 136. It will be appreciated that the positioning of the sensors 130, 132, 134, 136 allow detection of a tab T by one of the sensors prior to the other sensors detecting a skew of a leading edge E. Sensors 130, 132, 134, 136 may be comprised of reflective optical sensors which will produce a signal upon occlusion by paper sheets or the like. Other dimensions and positions of the sensors and nip roll pairs with respect to each other are possible. The above description and FIG. 3 are given as examples only.

As sheet S enters the deskewing arrangement and is advanced through nip roll pairs 110, 112, the tab T will occlude one of the sensors and the lead edge E will occlude the other sensors. Which sensor is occluded first depends on the location of the tab T. The order in which the other sensors are occluded depends on the direction of skew of the sheet S, and it is entirely possible that the sheet S will occlude a second, third, fourth, etc. sensor substantially simultaneously, thereby indicating no skew in the sheet. In either event, on occlusion, the sensors 130, 132, 134, 136 pass a signal to a controller system as will be described.

As shown in FIG. 2, the leading edge E of the media sheet S encounters sensors 130, 132, 134, and 136 positioned in line L downstream of the retard nip. In one example, four sensors are used. After a sheet crosses the sensors, a signal or time stamp from each sensor can be determined. Each sensor signal can be compared with every other signal to determine a skew of the media sheet. By comparing these time stamp signals it can be determined if a tab T has crossed the path of one of the sensors and the input or time stamp values from that sensor can be ignored. The skew of the sheet can then be determined using the remaining or 'non-ignored' sensor signals. This can be done in several ways. For example the two farthest apart non-ignored sensors can be used. Alternatively, the average skew from the non-ignored sensor pairs can be used. These methods can yield improved skew measurement accuracy over a conventional narrowly-spaced two sensor system.

There are many options for how the signal from the sensors can be used to determine the presence of a tab T and the skew of a sheet. Referring to FIGS. 3 and 4, one example is to calculate the skew, and compare the signals (i.e. paired comparisons) between sensors 130/132, 130/134, 130/136, 132/134, 132/136, and 134/136. If the tab T occluded sensor 134, for example, then the skew from signals 130/132, 130/136, and 132/136 would roughly match, or indicate a skew within a predetermined threshold. On the other hand, the varied, inconsistent, or exaggerated skews from signals 130/134, 132/134, and 134/136 would each be quite different from, less than, or greater than, the predetermined threshold (i.e. close to zero). In one exemplary embodiment, the skew angle defined by sensors 130/132, 130/136, and 132/136 will result in generally the same angle, i.e. angle a. In contrast, the skew angle defined by sensors 130/134 will be greater than a. The skew angle defined by sensors 132/134 will be much greater than a. And the skew angle defined by sensors 134/136 will be much less than a. In this example, the signals involving sensor 134 would be ignored and the sheet skew could then be determined using the time stamps or signal from sensors 130/136, i.e. the farthest apart non-ignored sensor signals. Alternatively, the skew can be determined by averaging the time stamps or signals from sensors 130/132, 130/136, and 132/136, i.e. all of the non-ignored sensor signals. This calculation could be a straight average of the remaining skew calculations, a weighted average (giving a greater weight to the skew calculated using the farthest apart sensor pair, for example) or another averaging technique.

Using the configuration described above, the multiple point sensors can also be calibrated using non-tabbed reference sheets to correct for any misalignment of the sensors. In this manner, the multiple sensors can also be used to improve the accuracy of the lead edge skew measurement, even when non-tabbed sheets are being registered. Since the straightness of the lead edge of any given piece of media, and the position of sheet within the baffle, can affect the trip point of a sensor, using three (3) or more sensors to detect the lead edge and averaging the results will yield a more accurate skew measurement than using two (2) sensors.

It is to be appreciated that the number of point sensors that can be used to perform this function can be less than four, for example three (3), if the amount of incoming skew is limited. For example, if three sensors are in place, 130, 134, 136, with sensor 134 now located along the path centerline C, and a tab occludes sensor 134, then large and inconsistent skew values will be detected when comparing 130/134 and 134/136. The signal comparison of 130/136 gives a skew value closer to zero or the predetermined threshold. In this case, the algorithm can ignore signal comparisons 130/134 and 134/136.

Alternatively, the system can have precise knowledge of each tabbed sheet (i.e. the exact location of the tab T), as is the case when printing onto the tabs themselves, then again only three sensors can be used, even with large amounts of input skew. For this algorithm, the known location of the tab T results in a known or identified occlusion of one of the sensors. The resultant associated signal can then be ignored from that sensor. The skew is then determined based on the comparison of the two non-ignored sensors.

Further, knowledge of the location of a tab could result from running a simplex side of a sheet and detecting the location of a tab T of a trailing edge by one of the sensors (not illustrated). After inverting, the location and timing offset (error) of the detected tab T can be correspondingly imposed onto the lead edge skew measurement on the same said one sensor when the tabbed sheet is being run on a duplex side.

In addition, if the length of the tab was known, then two (2) sensors can be used by adding an appropriate correction factor to one of the signals. It should also be appreciated that a system similar to that shown in FIG. 2 can be arranged having an array sensor instead of the multiple point sensors. The signal from the array sensor can be used to determine if a tabbed sheet was present by determining a sudden shift in observed lateral position, and if so, ignoring the portion of the signal caused by the tab and determine the lead edge skew of the sheet using trip time data from the non-tabbed portion of the sheet's leading edge. As described above, sensors 130, 132, 134, 136 provide control signals to the control system to provide sensing information. Operation of the driving rollers can be controlled from the sensing information. Additionally, the controller can drive stepper motors in accordance with the required movement and rotational velocity of the driving rollers (not illustrated). In one typical example, stepper motors can be driven in a halfstep mode, although full step or microstep modes of operation could be used. Motor revolutions can thus be divided into a large number of halfsteps, each halfstep providing an exact increment of rotation movement of the motor shafts, and thus the driving rollers. In accordance with this scheme, a pair of motor driver boards (not shown) provide a pulse train to incrementally drive the motors.

With reference to FIGS. 2 and 3, the deskew process will now be described more specifically. Sheet S having an unknown amount of skew angle a (not illustrated) enters the nip roll pairs and is driven non-differentially thereby, at a constant velocity Vo. As it is advanced, lead edge E passes by and occludes sensors 130, 132, 134, 136. For the purpose of the deskew process, it will be assumed that tab T occludes sensor 134 and sensor 136 is occluded by lead edge E first. If the two farthest apart sensors are being used to determine skew, sensor 136 provides an occlusion signal to the controller, whereby, the controller commences counting the halfsteps generated by motor driver boards as sheet S is driven non-differentially through the nips by the motors, past sensor 136, and recording the number of halfsteps counted until sensor 130 also indicates occlusion by sheet lead edge E. As there is assumed to be a linear relationship between the number of motor halfsteps counted and travel by the sheet lead edge E, it can be seen that:

$$N=D/K \tag{1}$$

where,

N=number of motor halfsteps;

K=a constant equal to the advancement of the driving roller surface for each motor halfstep; and D=the difference distance traveled by the portion of the sheet which originally occluded 136 until 130 is occluded.

Thus, it can also be seen that $$a=\tan-1(D/Sx) \tag{2}$$

or for small angles $$a=D/Sx \tag{3}$$

where, a=the random skew angle of a sheet entering the nips; and Sx=distance between sensors 130 and 136.

Because K and Sx are constants for a particular registration subsystem, a sufficient measure of the skew angle of the sheet as it enters the registration and deskewing arrangement is simply N, the number of motor halfsteps taken between occlusion of sensor 136 and sensor 130, while the motors are driven non-differentially. It should be appreciated that instead of counting the number of half steps driven by the motors, the controller could associate a time stamp with each sensor trip event and the distance D could then be calculated based on the average velocity and time difference between two sensor trip events (i.e. trip times). That is, D=V*(Tsensor136−Tsensor130), and so forth for each sensor pair.

With the skew angle a of the sheet known, the sheet is rotated in a selected direction, for example clockwise, looking down on FIG. 2 to compensate for the skew angle a. This rotation can be accomplished simultaneously with continuing advancement along paper path P1. It is to be appreciated that when the sheet first enters the nips, both motors are operating at substantially similar speed to drive the sheet non-differentially at a velocity Vo, at T1, sensor 136 is occluded by lead edge E of sheet S, while at T2, sensor 130 is similarly occluded. In accordance with the detected random skew angle a of the sheet, one of the motors can be driven at an increased velocity V2 while another one of the motors can be driven at a decreased velocity V1.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. In addition, the claims can encompass embodiments in hardware, software, or a combination thereof.

The invention claimed is:

1. A printing system, comprising:

a media registration transport for transporting a media sheet along a path;

a sensing system including a plurality of sensors positioned substantially in line and orthogonal to the feed direction of said sheet path for detecting a leading edge of the media sheet;

a control system for detecting signals at the times when each of said plurality of sensors are occluded;

said control system including a control algorithm comparing each one of said sensor signals with every other of said sensor signals forming a series of paired comparisons;

said control algorithm identifies at least one paired comparison of sensor signals having inconsistent readings with the other paired comparisons of sensor signals;

said control algorithm determines presence of a tab on said leading edge based on said inconsistent at least one paired comparison of sensor signal readings;

said control algorithm removes said at least one paired comparison of inconsistent sensor signals to determine a skew of said leading edge based on said other paired comparisons; and, said media registration transport performs a deskew operation on said media sheet based on said skew of said leading edge.

2. The printing system of claim 1, wherein said control algorithm identifies the two farthest apart said other sensors and compares the respective said sensor signals to determine said skew of said leading edge.

3. The printing system of claim 1, wherein said control algorithm calculates said skew of said leading edge based on said other paired comparisons including averaging techniques on associated sensor signals to determine said skew of said leading edge.

4. The printing system of claim 1, wherein said inconsistent readings are relative values.

5. The printing system of claim 4, wherein said inconsistent readings are greater than a predetermined threshold value.

6. The printing system of claim 1, wherein said sensors are point sensors and said plurality of sensors includes at least three sensors.

7. A method of printing, including:

transporting a media sheet along a media registration transport path;

detecting a leading edge of said media sheet including a sensing system with a plurality of sensors positioned substantially in line and orthogonal to the feed direction of said sheet path;

detecting signals at the times when at least three of said plurality of sensors are occluded by said leading edge;

comparing each one of said sensor signals with every other of said sensor signals forming a series of paired comparisons;

identifying at least one paired comparison of sensor signals having inconsistent readings with the other paired comparisons of sensor signals;

determining presence of a tab on said leading edge based on said inconsistent at least one paired comparison of sensor signal readings;

determining a skew of said leading edge based on selecting one of the paired comparisons having a skew substantially equal to zero; and, performing a deskew operation on said media sheet based on said skew of said leading edge.

8. The method of printing according to claim 7, wherein said inconsistent sensor readings include at least two of said paired comparisons.

9. A method of printing, including:

transporting a media sheet along a media registration transport path;

detecting a leading edge of said media sheet including a sensing system with a plurality of sensors positioned substantially in line and orthogonal to the feed direction of said sheet path;

detecting signals at the times when at least three of said plurality of sensors are occluded by said leading edge;

comparing each one of said sensor signals with every other of said sensor signals forming a series of paired comparisons;

identifying at least one paired comparison of sensor signals having inconsistent readings with the other paired comparisons of sensor signals;

determining presence of a tab on said leading edge based on said inconsistent at least one paired comparison of sensor signal readings;

identifying a location of said tab and at least one associated sensor occluded thereby;

determining a skew of said leading edge based on selecting said other paired comparisons of sensor signals; and, performing a deskew operation on said media sheet based on said skew of said leading edge.

10. The method of printing according to claim 9, wherein said plurality of sensors are point sensors.

11. The method of printing according to claim 10, further including at least another point sensor and removing said inconsistent at least one paired comparison readings to determine said skew of said leading edge.

12. The method of printing according to claim 11, further including identifying the two farthest apart sensors and comparing the respective at least one paired comparison of said sensor signals to determine said skew of said leading edge.

13. The method of printing according to claim 11, further including identifying all of the other sensors and averaging the respective paired comparisons of said other sensor signals to determine said skew of said leading edge.

14. The method of printing according to claim 7, wherein said inconsistent readings are relative values.

15. A printing system, comprising:

a media registration transport for transporting a media sheet along a path;

a sensing system including a plurality of sensors positioned substantially in line and orthogonal to the feed direction of said sheet path for detecting a leading edge of the media sheet;

a control system for detecting trip times when at least three of said plurality of sensors are occluded;

said control system including a control algorithm comparing each one of said sensor signals with every other of said sensor signals forming a series of comparisons;

said control algorithm identifies at least one sensor signal having inconsistent readings with the other sensor signals;

said control algorithm determines presence of a tab on said leading edge based on said inconsistent at least one comparison of sensor signal readings;

said control algorithm removes said inconsistent at least one comparison to determine a skew of said leading edge based on said other comparisons of said sensor signals; and said media registration transport performs a deskew operation on said media sheet based on said skew of said leading edge.

16. The printing system of claim 15, wherein said control system calibrates said plurality of sensors relative to each other by transporting a known set of rectangular media through said media registration transport and comparing the trip times of said plurality of sensors.

17. The printing system of claim 15, further including at least a fourth sensor wherein said control algorithm detects at least two sensor signals having inconsistent readings with said other of said sensor signals.

18. The printing system of claim 15, wherein said plurality of sensors are an array sensor.

19. A printing system, comprising:

a media registration transport for transporting a tabbed media sheet along a sheet path;

a sensing system including at least three sensors positioned substantially in line and orthogonal to a feed direction of said sheet path for detecting a leading tab edge of said tabbed media sheet;

a control system for detecting trip times and at least three sensor signals when each of said at least three sensors are occluded;

said control system including a control algorithm having knowledge of a location of a tab on said tabbed media sheet to determine which one of said at least three sensor signals is to be ignored when calculating a sheet skew based on said trip times of said at least three sensors; and, said media registration transport performs a deskew operation on said tabbed media sheet based on said sheet skew.

20. A printing system, comprising:

a media registration transport for transporting a media sheet having a leading tab along a path; a sensing system including at least three sensors positioned substantially in line and orthogonal to the feed direction of said sheet path for detecting a leading edge of the media sheet;

a control system for detecting trip times from at least three sensor signals when each of said at least three sensors are occluded;

said control system including a control algorithm having knowledge of a location and a width of said tab on said media sheet and using a correction factor to one of said at least three sensor signals to compensate for said width of said tab when calculating a sheet skew based on said trip times of said at least three sensors; and, said media registration transport performs a deskew operation on said media sheet based on said sheet skew of said leading edge.

* * * * *